United States Patent [19]

Paakkinen

[11] Patent Number: 4,668,447

[45] Date of Patent: May 26, 1987

[54] METHOD AND DEVICE FOR THE CASTING OF CONCRETE PRODUCTS

[75] Inventor: Ilmari Paakkinen, Savonlinna, Finland

[73] Assignee: Oy Partek AB, Toijala, Finland

[21] Appl. No.: 726,660

[22] Filed: Apr. 24, 1985

[30] Foreign Application Priority Data

Apr. 24, 1984 [FI] Finland ..... 841612

[51] Int. Cl.[4] ..... B28B 1/10

[52] U.S. Cl. ..... 264/70; 264/71; 264/312; 425/64; 425/426; 425/427

[58] Field of Search ..... 264/312, 69, 70, 71, 264/72; 425/64, 427, 428, 432, 426

[56] References Cited

U.S. PATENT DOCUMENTS

| | | | |
|---|---|---|---|
| 3,200,177 | 8/1965 | Dodd | 264/70 |
| 3,608,012 | 9/1971 | Jonell et al. | 264/70 |
| 3,877,860 | 4/1975 | Putti | 425/380 |
| 4,133,619 | 1/1979 | Wise | 425/64 |
| 4,202,658 | 5/1980 | Ahonen | 425/64 |
| 4,229,153 | 10/1980 | Hight | 425/64 |
| 4,330,242 | 5/1982 | Putti | 425/64 |
| 4,545,946 | 10/1985 | Sarja | 264/70 |

FOREIGN PATENT DOCUMENTS

| | | | |
|---|---|---|---|
| 477033 | 10/1973 | Australia | 425/64 |

*Primary Examiner*—Jan H. Silbaugh
*Assistant Examiner*—Mary Lynn Fertig
*Attorney, Agent, or Firm*—Burns, Doane, Swecker & Mathis

[57] ABSTRACT

Method and device for the casting of concrete products either by means of a periodic method or by means of a continuous slide casting method. Into the product, one or several cavities are formed by means of a cavity mandrel (4). The mix is compacted by rotating the cavity mandrel (4) back and forth around its longitudinal axis.

18 Claims, 11 Drawing Figures

METHOD AND DEVICE FOR THE CASTING OF CONCRETE PRODUCTS

The present invention is concerned with a method for the casting of oblong concrete products, in which said concrete products there are one or several longitudinal cavities, either by means of a periodic method or by means of a continuous slide casting method, whereby cavities are formed into the concrete product by means of a cavity mandrel. The invention is also concerned with a device for the casting of concrete products either by means of a periodic method or by means of a continuous slide casting method, whereby the device comprises a bottom plane and side walls as well as one or several displaceable cavity mandrels for the purpose of forming a cavity into the product to be cast.

Besides such cavities whose cross section is surrounded by concrete from all sides, a cavity is supposed to be understood herein as also meaning longitudinal recesses in the concrete product with one of the sides of the recesses open.

For the purpose of casting hollow slabs out of concrete by a periodic method, it is known in prior art to use a so-called tube-pulling device. In such a case, the casting formwork comprises a bottom plane, side walls, as well as tubes passing through the formwork, the cavities being formed in the slab to be cast in the positions of the said tubes. In this method, so-called semi-viscous mix is used, with which the formwork is filled. After the compacting of the mix, the tubes are pulled out of the cavities.

The slide casting method is a continuous method, and therein it is possible to use a highly viscous mix. The mix is fed into the formwork by means of feed screws. As extensions of the feed screws, there are cavity mandrels provided with internal vibrators, which said mandrels compact the mix. During casting, the machine moves along its base on wheels, while hollow slab is extruded from one of its ends.

It is a problem in particular in a tube-pulling device how to compact the mix in the portions of the slab placed underneath the tubes. On the other hand, in slide casting machines provided with a vibrator, a drawback consists of the noise caused by the vibrator.

The method in accordance with the present invention is characterized in that the pressurized concrete mix is compacted by rotating the cavity mandrel back and forth around its longitudinal axis. The device in accordance with the invention is characterized in that the cavity mandrel can be rotated in the formwork back and forth around its longitudinal axis.

By means of the invention, the mix in the slab to be cast can be compacted in an efficient way.

BRIEF DESCRIPTION OF THE DRAWING

A preferred embodiment of the invention will be described in more detail in the following with reference to the attached drawings, wherein.

DETAILED DESCRIPTION OF THE PREFERRED EMBODIMENTS

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

Figure 1:
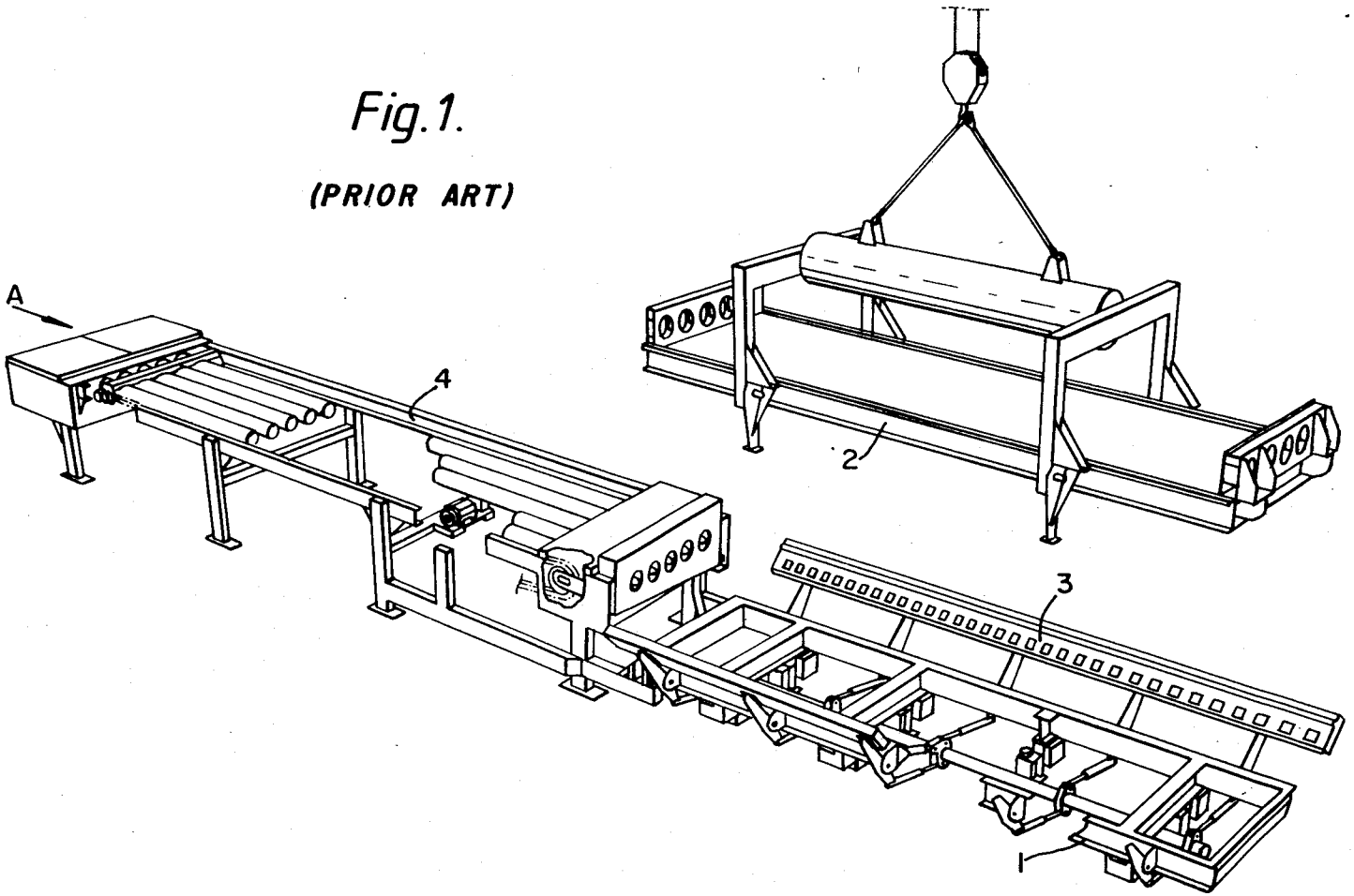
Fig. 1. (PRIOR ART)
FIG. 1 is a perspective view of a tubepulling device in itself known.

The tube-pulling device shown in FIG. 1, in itself known, is provided with a base 1, onto which the frame 2 of the formwork is laid. The pivotable side walls 3 are pivoted to the sides of the formwork, and the tubes 4 are pushed into the formwork. Thereupon the casting mix is poured into the mould, and the mix is compacted by making use of the hydrostatic pressure of the mix and by vibrating the mix. Upon hardening of the mix, the tubes 4 are again pulled out of the formwork to the other end of the device, and the casting is repeated with a new formwork.

Figure 2:
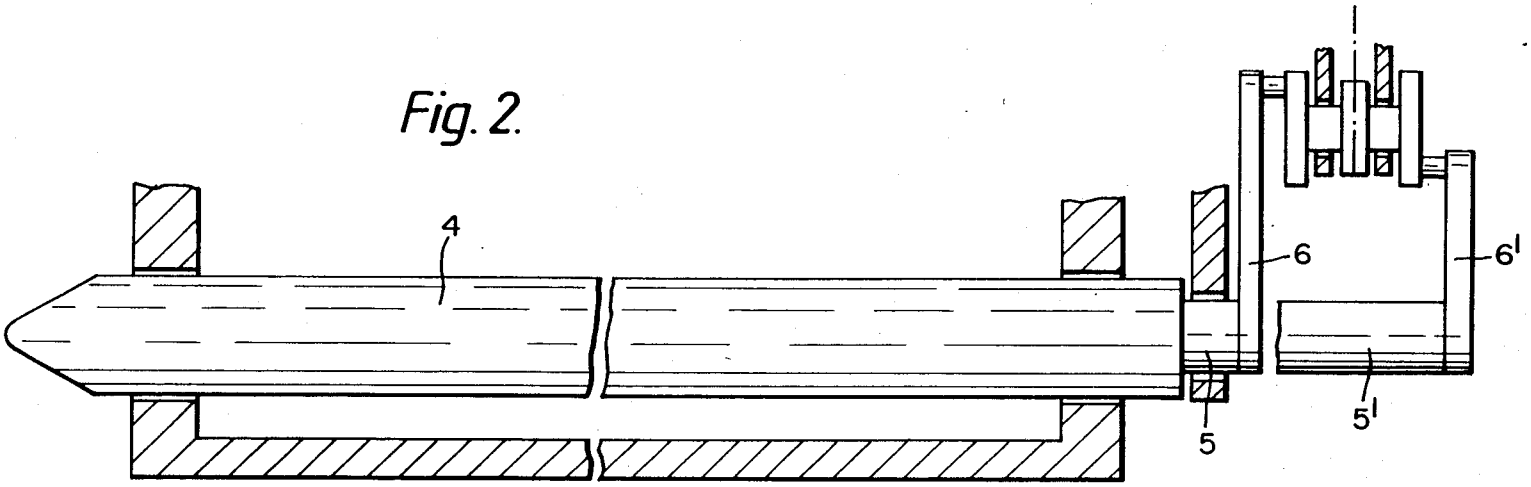
FIG. 2 is a schematical side view in detail for the application of a preferred embodiment of the present invention in a tube-pulling device.
Figure 3:
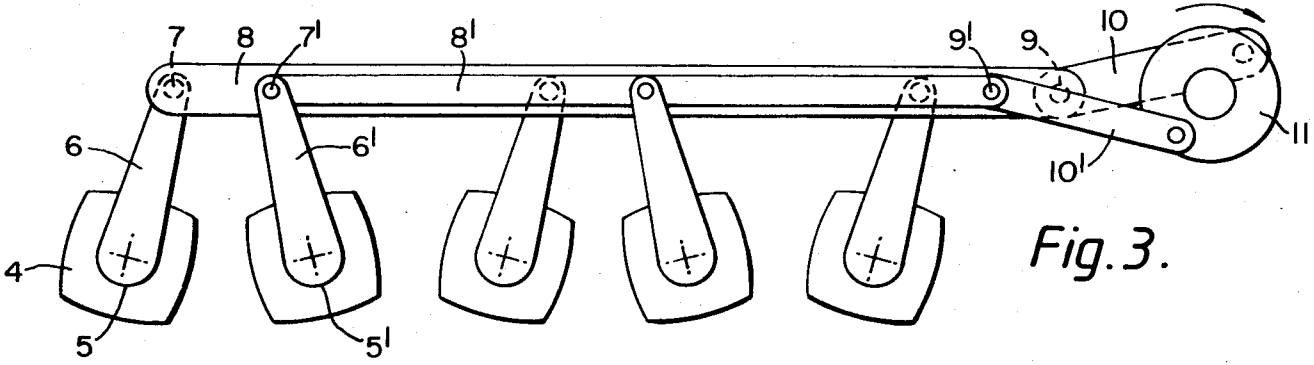
FIG. 3 shows the same detail as viewed in the direction of the arrow A in FIG. 1.

FIGS. 2 and 3 show the arm construction for moving the tubes 4 in the tube-pulling device, in accordance with the present invention, back and forth around their longitudinal axis. The arm construction may be fitted in the machine shown in FIG. 1, e.g., at the right-side end in the figure. After the tubes 4 have been pushed into the formwork, they are connected to the turning shafts 5. The shafts 5 are connected to the turning arms 6. Every other turning arm 6 is connected by means of the articulated joint 7 to the transverse arm 8, and every other turning arm 6' is connected by means of the articulated joint 7' to the transverse arm 8'. Connecting rods 10 and 10' are attached to one end of the transverse arms 8 and 8' by means of articulated joints 9 and 9', and the said connecting rods 10 and 10' are attached to a rotary disc 11 eccentrically. When the disc 11 revolves, the arms 8 and 8' move back and forth in opposite directions. Thereby the tubes 4, attached to the shafts 5 permanently, are turned along with the shafts 5 back and forth over a certain angle, so that two tubes placed side by side are always turned in opposite directions relative each other. The magnitude of the turning angle is at the maximum 180°, preferably no more than 90°, in particular 5° to 50°, and the frequency of the swinging movement is, e.g., 2 to 10 c/s.

At the time of casting, the casting mix is relatively fluid and adheres partly to the tubes 1, in particular if the tubes are not of circular section. The movement of the tubes is transferred into the mix and compacts and shifts the mix into the poorly compacted portions of the casting object.

Figure 4:
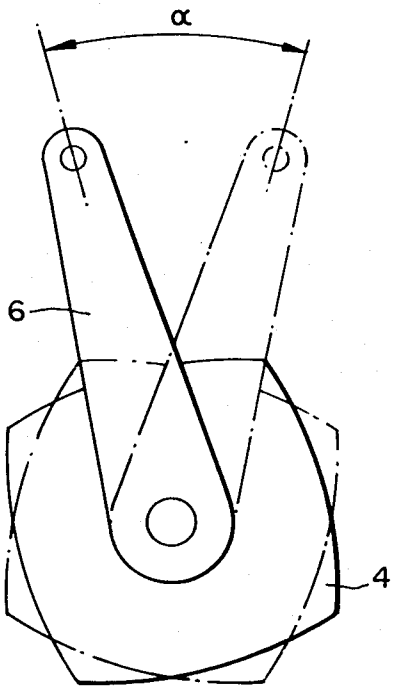
FIG. 4 is a cross-sectional view of a tube in accordance with one embodiment, to be used in the device in accordance with the invention.

FIG. 4 shows a tube 4 section that is close to square. When such a shape is used, economies are obtained in the quantity of casting mix, and the weight of the slab to be cast is reduced. An appropriate width $\alpha$ of the turning angle of the tube is, for the section shown in FIG. 4, for example, about 20°. The appropriate turning angle depends on the diameter of the tube. Measured on the circumference of the tube, an appropriate amplitude of the movement is about 2 to 20 mm.

Adjoining tubes may be moved as synchronized relative each other in opposite directions or in the same direction. The turning movement may be produced, besides mechanically, also hydraulically or pneumatically.

Figure 5:
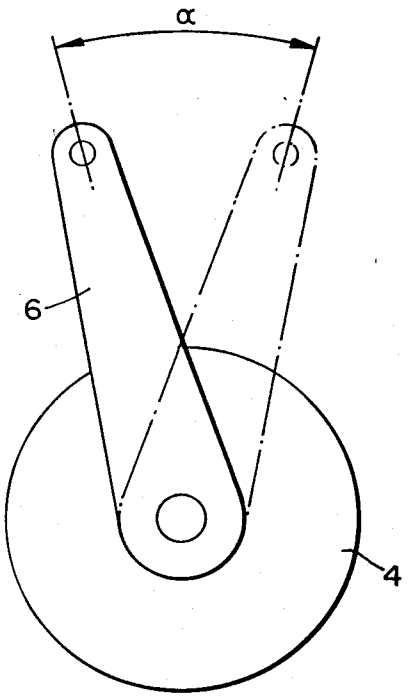
FIG. 5 is a cross-sectional view of a tube in accordance with a second embodiment.

FIG. 5 shows a circular section of a tube.

Figure 6:
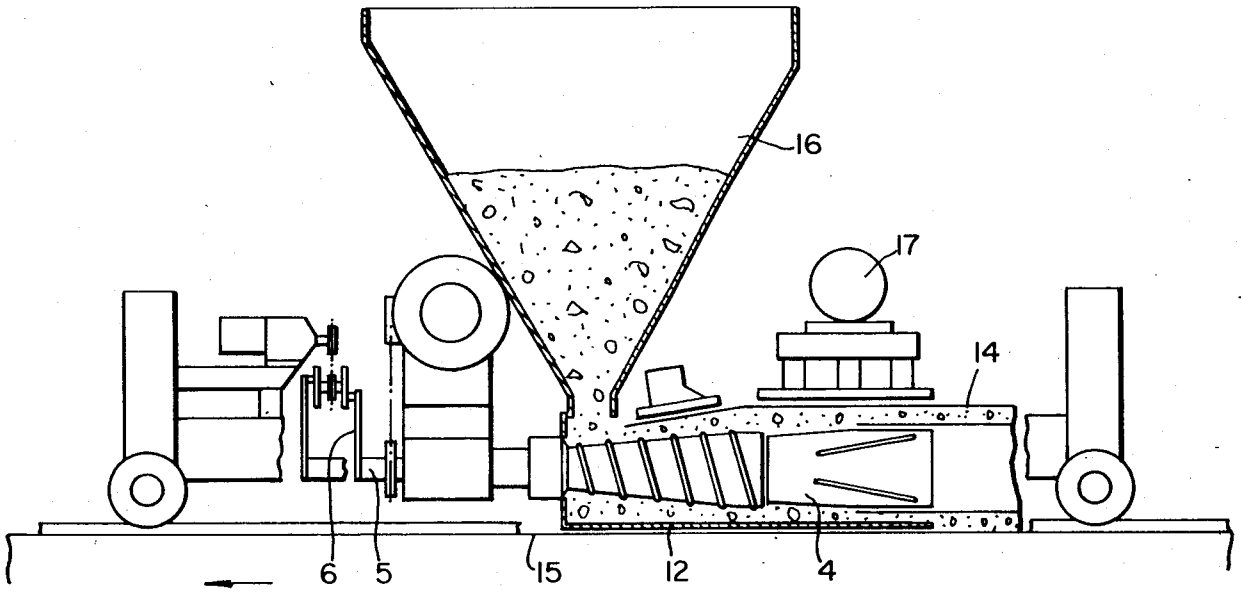
FIG. 6 is a side view of a slide casting machine in itself known, wherein a preferred embodiment of the present invention has been applied.
Figure 7:
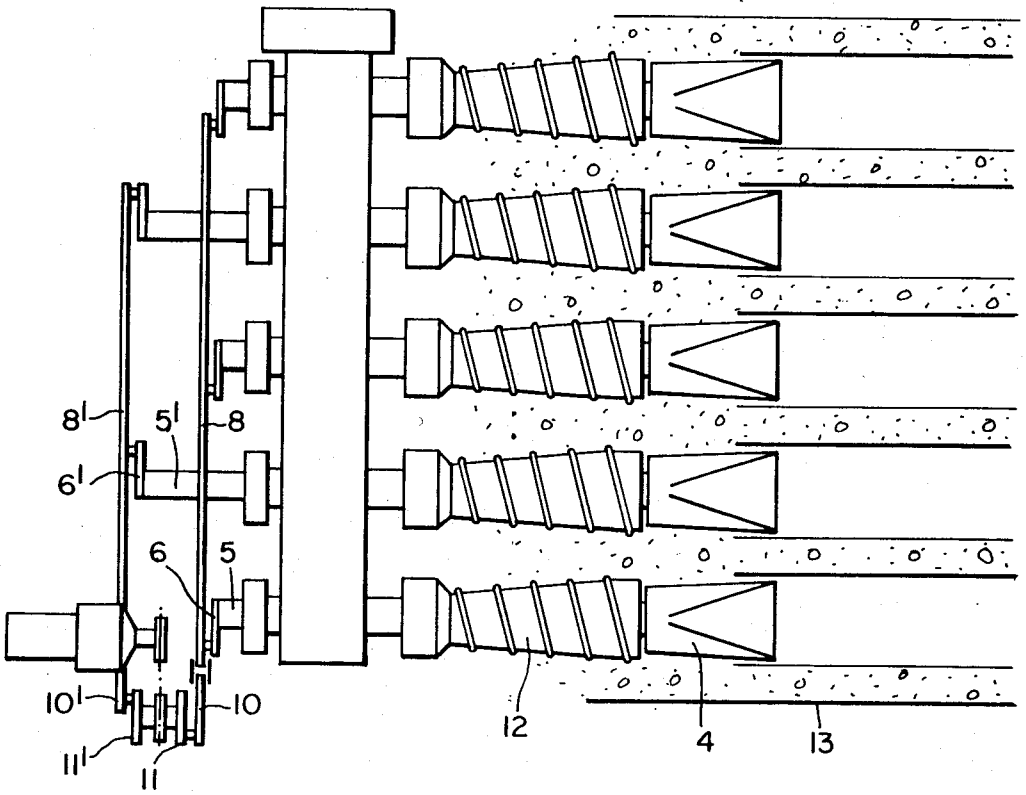
FIG. 7 shows the same machine as viewed from above.

FIGS. 6 and 7 show a slide casting machine for the application of the invention. The feeder spiral 12 is fitted on a cone widening towards the final end of the machine. After the feeder spiral, a cavity mandrel 4 is fitted. Depending on the number of the cavities, several feeder spirals and cavity mandrels are fitted side by side. The machine further comprises side boards 13 and a deck board 14, a base 15, along which the machine travels in the direction indicated by the arrow, a feeder funnel 16 for feeding the concrete into the formwork, and a vibrator 17. The above is in itself known from conventional slide casting machines.

The cavity mandrel 4 is fixed stationarily to the shaft 5 passing through the spiral 12. The shafts 5 are attached to turning arms 6, which are further linked to two transverse arms 7 and 7' in a way corresponding to the tube-pulling device shown in FIGS. 2 and 3. The connecting rods 10 and 10' are, in this embodiment, attached eccentrically to two separate discs 11 and 11'. Correspondingly, when the discs 11 and 11' revolve, the arms 8 and 8' perform a movement back and forth and swing the turning arms 6 and 6', whereby the shafts 5 and, along with them, the cavity mandrels 4 perform a turning movement back and forth around their longitudinal axis.

Figure 8:
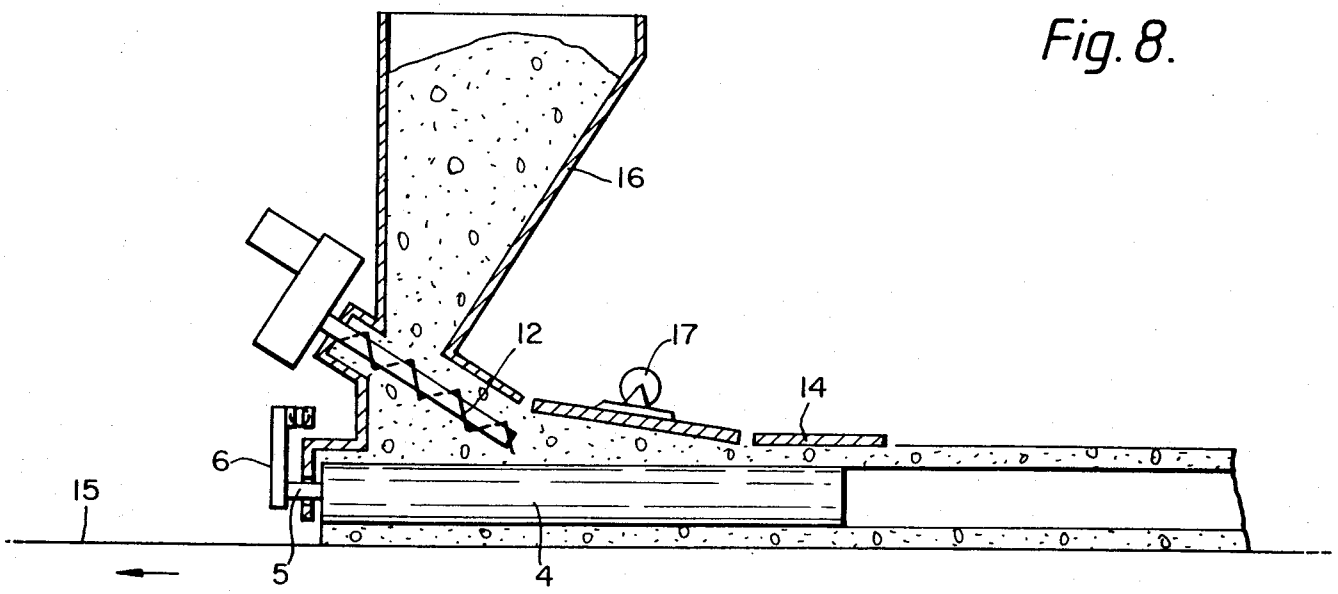
FIG. 8 is a side view of a second alternative of a slide casting machine in which a preferred embodiment of the present invention has been applied.
Figure 9:
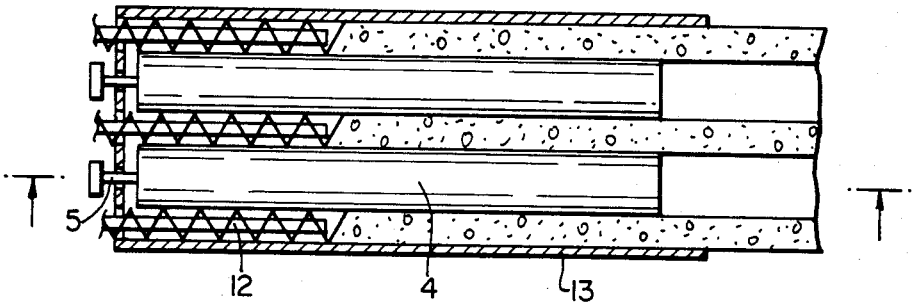
FIG. 9 is a sectional view from above of the device shown in FIG. 8.

FIGS. 8 and 9 show another solution for a slide casting machine in accordance with the invention. The feeder spirals 12 in the device of FIGS. 6 and 7 have been replaced by feeder screws 12 fitted above the mandrels 4, in a diagonal position between the mandrels. The screws 12, which generate the pressure in the concrete mix, feed the mix onto the mandrels 4, which are moved in accordance with the invention by means of the arms 6 back and forth. Thereby the mix is compacted. If necessary, the compacting effect is intensified, e.g., by means of a vibrator 17.

Figure 10:
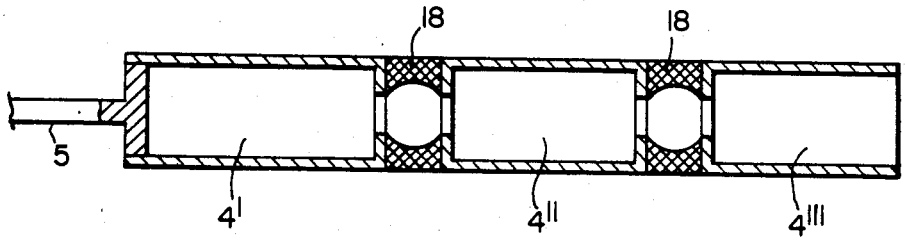
FIG. 10 shows a cavity mandrel which is suitable for use in a device in accordance with a preferred embodiment of the invention.

FIG. 10 shows a mandrel 4 consisting of three parts, which said parts 4', 4'' and 4''' are interconnected by means of resilient rubber coupling components 18. When the feed end 4' of the mandrel is moved by means of the shaft 5 back and forth, the movement of the mandrel in its different parts becomes smaller towards the trailing end 4''' of the mandrel. At the trailing end of the mandrel, the cross-section of the mandrel part may be shaped so that it differs from circular, whereby the trailing end moves very little and leaves a smooth cavity.

Figure 11:
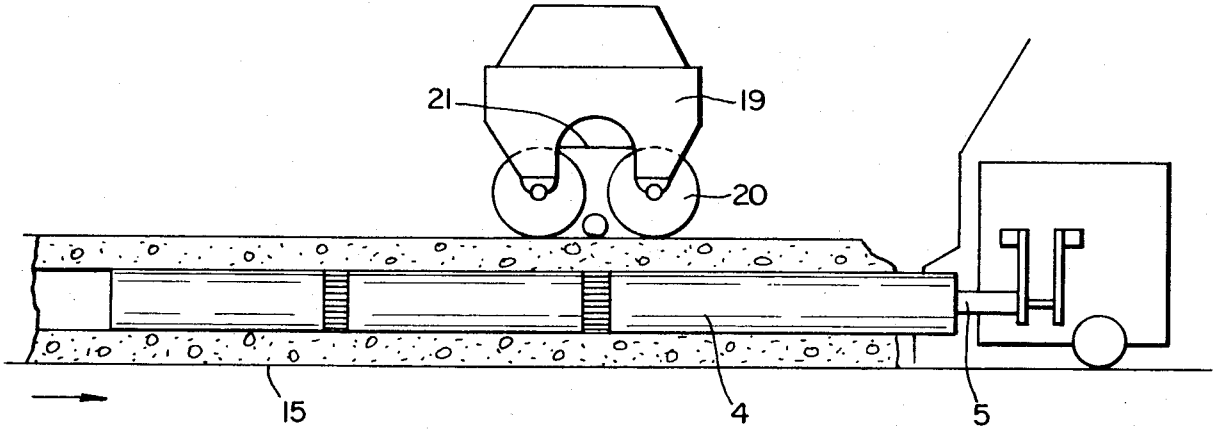
FIG. 11 is a side view of a further embodiment of a device in accordance with the invention.

FIG. 11 shows a further, simple compacting device in accordance with the invention.

The concrete mix is introduced onto the mandrels 4 by means of an appropriate conveyor device or vessel (not shown in the figure). The compacting device 19 consists of two or three rolls 2, over which an endless mat 21 runs. The compacting device presses the concrete into the formwork and against the mandrels 4. The mandrels 4, which consist of 3 parts, move in accordance with the invention back and forth around their longitudinal axis and compact the pressurized mix. The casting device is shifted forwards in the direction of the arrow along the base 15 of the formwork as compacting has taken place.

Besides by means of the feeder screws 12 or the compacting device 19 described above, the concrete mix may also be pressurized by using a sufficiently high feeder funnel, whereby the hydrostatic pressure produces an adequate pressure in the formwork around the mandrels 4.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. A method of casting concrete products having at least one longitudinal cavity, said method comprising the steps of:

forming the product with said longitudinal cavity by passing a pressurized concrete mix by a cavity mandrel;

providing said cavity mandrel with a non-circular cross-sectional shape; and during said forming step, compacting the pressurized concrete mix by rotating the non-circular cavity mandrel back and forth about its longitudinal axis by a turning angle of rotation not greater than 180°.

2. The method as claimed in claim 1, wherein said forming step is performed by either one of a periodic process or a continuous slide casting process.

3. The method as claimed in claim 2, wherein the amplitude of the rotation of the cavity mandrel on the circumference of the cavity mandrel is at least 2 mm.

4. The method as claimed in claim 2, wherein a turning angle of the rotation of the cavity mandrel is reduced at the end of the compacting step.

5. The method as claimed in claim 2, wherein adjacent members of a plurality of cavity mandrels are rotated in opposite directions relative each other.

6. The method as claimed in claim 2, wherein a plurality of cavity mandrels are rotated in same directions relative to each other.

7. The method as claimed in claim 2, further comprising the step of moving the cavity mandrel in a longitudinal direction at the same time as it is rotated back and forth about its longitudinal axis.

8. The method as claimed in claim 2, further comprising the step of generating pressure in the concrete mix with a feeder screw.

9. The method as claimed in claim 3, wherein the turning angle of the cavity mandrel is reduced at the end of the compacting step.

10. The method as claimed in claim 3, wherein adjacent members of a plurality of cavity mandrels are rotated in opposite directions relative each other.

11. The method as claimed in claim 4, wherein adjacent members of a plurality of cavity mandrels are rotated in opposite directions relative each other.

12. The method as claimed in claim 3, wherein a plurality of cavity mandrels are rotated in the same directions relative to each other.

13. The method as claimed in claim 4, wherein a plurality of cavity mandrels are rotated in the same directions relative to each other.

14. A device for casting of a concrete product from a concrete mix either by a periodic method or by a continuous slide casting method, said device comprising a bottom plane, side walls, at least one cavity mandrel adapted to form a cavity in the product and means for compacting the concrete mix, said compacting means including means for rotating said cavity mandrel back and forth about its longitudinal axis by a turning angle of rotation not greater than 180° and said cavity mandrel having a non-circular cross-sectional shape, whereby upon rotation of said cavity mandrel said concrete mix is compacted.

15. The device as claimed in claim 14, wherein said device includes a plurality of cavity mandrels and said rotating means includes turning arms which are are operative connected to said cavity mandrels, said turning arms connected eccentrically to a revolving drive member.

16. The device as claimed in claim 14 further comprising feeder screw means for generating pressure in the concrete mix, said feeder screw means positioned above the cavity mandrels.

17. The device as claimed in claim 14 further comprising a press device adapted to press concrete against said cavity mandrel, said press device including an endless press mat mounted upon press rolls.

18. The device as claimed in claim 14, wherein the cavity mandrel is divided in the longitudinal direction into several sections, which sections are interconnected by elastic joint components, whereby the magnitude of rotation is diminishes from section to section in a direction away from said rotating means.

* * * * *